US010312006B2

(12) United States Patent
Yamamoto et al.

(10) Patent No.: US 10,312,006 B2
(45) Date of Patent: Jun. 4, 2019

(54) UNDULATOR MAGNET, UNDULATOR, AND RADIATION LIGHT GENERATING DEVICE

(71) Applicant: Inter-University Research Institute Corporation High Energy Accelerator Research Organization, Ibaraki (JP)

(72) Inventors: Shigeru Yamamoto, Ibaraki (JP); Jun Taniguchi, Saitama (JP)

(73) Assignee: INTER-UNIVERSITY RESEARCH INSTITUTE CORPORATION HI, Ibaraki (JP)

( * ) Notice: Subject to any disclaimer, the term of this patent is extended or adjusted under 35 U.S.C. 154(b) by 0 days.

(21) Appl. No.: 16/117,586

(22) Filed: Aug. 30, 2018

(65) Prior Publication Data

US 2019/0080828 A1 Mar. 14, 2019

(30) Foreign Application Priority Data

Sep. 12, 2017 (JP) ..... 2017-174598

(51) Int. Cl.
*H01F 7/02* (2006.01)
*H05H 7/04* (2006.01)

(52) U.S. Cl.
CPC ..... *H01F 7/0278* (2013.01); *H05H 7/04* (2013.01); *H05H 2007/041* (2013.01)

(58) Field of Classification Search
CPC ... H01F 7/0278; H05H 7/04; H05H 2007/041
(Continued)

(56) References Cited

U.S. PATENT DOCUMENTS 4,800,353 A 1/1989 Csonka et al.
9,275,781 B2 * 3/2016 Temnykh ..... H01S 3/0903
2017/0339777 A1 * 11/2017 Kinjo ..... H05H 13/04

FOREIGN PATENT DOCUMENTS

JP H04134299 A 5/1992
JP H1027699 A 1/1998
(Continued)

OTHER PUBLICATIONS

Shigeru Yamamoto, Development of Very Short Period Undulators III, Proceedings of the 13th Annual Meeting of Particle Accelerator Society of Japan, 1035-1039, 2016.

*Primary Examiner* — Michael Maskell
(74) *Attorney, Agent, or Firm* — Carter, Deluca & Farrell LLP

(57) ABSTRACT

An undulator magnet having favorable transportation workability is provided. Specifically, an undulator permanent magnet used for an undulator is provided that generates radiation light by meandering electrons that travel in a first direction, wherein, in the undulator permanent magnet, one end surface in the first direction forms a first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$.

26 Claims, 8 Drawing Sheets

(58) Field of Classification Search
USPC ..... 250/396 R, 396 ML, 504 R, 493.1
See application file for complete search history.

(56) References Cited

FOREIGN PATENT DOCUMENTS

| | | | |
|---|---|---|---|
| JP | 2001110598 | A | 4/2001 |
| JP | 2001110599 | A | 4/2001 |
| JP | 2002134300 | A | 5/2002 |
| WO | 2016063740 | A1 | 4/2016 |

* cited by examiner

UNDULATOR MAGNET, UNDULATOR, AND RADIATION LIGHT GENERATING DEVICE

BACKGROUND OF THE INVENTION

Field of the Invention

The present invention relates to an undulator magnet, an undulator, and a radiation light generating device.

Description of the Related Art

In an undulator used for a radiation light generating device that generates radiation light with a shorter wavelength and high energy, in order to obtain radiation light with higher brightness, it is necessary to lengthen permanent magnets used in the undulator in a traveling direction of electrons. In the technology of Non Patent Literature 1, after permanent magnets are connected, they are magnetized after being connected so that a periodic alternating magnetic field is generated, and thus the undulator permanent magnets are lengthened. In addition, two permanent magnets are connected after magnetization, and the undulator permanent magnets are lengthened.

Non Patent Literature

[Non Patent Literature 1] Shigeru Yamamoto, Development of very short period undulators III, Proceedings of the 13th Annual Meeting of Particle Accelerator Society of Japan, 1035-1039, 2016

SUMMARY OF THE INVENTION

However, in the technology of Non Patent Literature 1, regarding the lengthened undulator permanent magnets, even if connection between the magnets after magnetization is released and then they are connected again, a magnetic field of a connecting part before releasing may not be accurately reproduced in some cases. Thus, for example, since it is necessary to maintain connection between magnets and a state of the magnetic field in a connection state during transportation, there is a problem of workability during transportation. In addition, in Non Patent Literature 1, a specific magnetization method is not sufficiently disclosed.

According to the present invention, for example, even if undulator magnets are connected after magnetization, a magnetic flux density distribution of a connecting part and parts near the connecting part is a magnetic flux density distribution having favorable stability that does not influence the stability of an electron trajectory, and accordingly, the undulator magnet having favorable transportation workability is provided.

In order to address the above problems, an exemplary first invention of the present invention provides an undulator permanent magnet used for an undulator that generates radiation light by meandering electrons that travel in a first direction, wherein, in the undulator permanent magnet, one end surface in the first direction forms a first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$.

In order to address the above problems, an exemplary second invention of the present invention provides a method of installing undulator permanent magnets in an undulator that generates radiation light by meandering electrons that travel in a first direction, the method including:

magnetizing a plurality of permanent magnets;

accommodating the plurality of magnetized permanent magnets in a transport container;

transporting the transport container in which the plurality of permanent magnets are accommodated to the undulator;

connecting the plurality of permanent magnets removed from the transport container that is transported and lengthening them in the first direction to obtain a magnet array; and installing the obtained magnet array in the undulator.

According to the present invention, for example, even if undulator magnets are connected after magnetization, a magnetic flux density distribution of a connecting part and parts near the connecting part is a magnetic flux density distribution having favorable stability that does not influence the stability of an electron trajectory, and accordingly, the undulator magnet having favorable transportation workability can be provided.

DESCRIPTION OF THE EMBODIMENTS

Forms for implementing the present invention will be described below with reference to the drawings.

First Embodiment

<Undulator>

Figure 1:
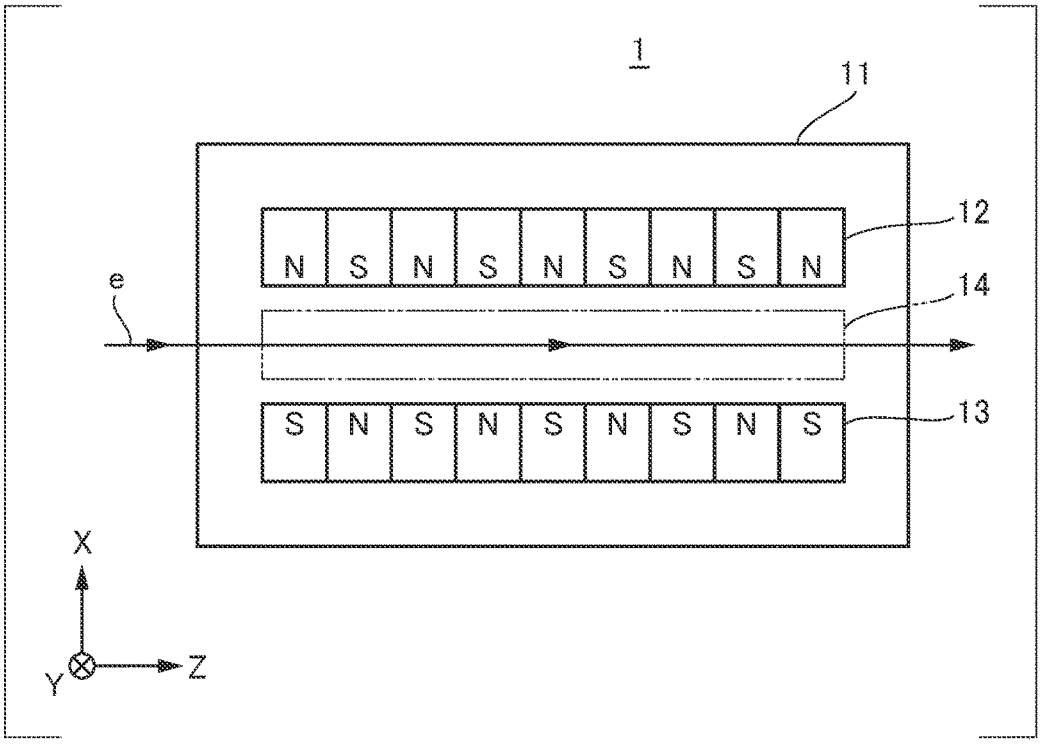
FIG. 1 is a diagram showing an overview of a configuration of an undulator using undulator permanent magnets according to a first embodiment.

FIG. 1 is an overview diagram showing a configuration of an undulator using undulator permanent magnets according to the present embodiment. An undulator 1 generates radiation light by meandering an electron beam e. The undulator 1 includes a vacuum chamber 11, a first magnet array 12, and a second magnet array 13.

The first magnet array 12 and the second magnet array 13 are a pair of magnet arrays that are arranged to face each other with a passage 14 through which the electron beam e passes therebetween. The passage 14 is formed longer in a predetermined direction in which the electron beam e passes. The predetermined direction is a z direction. The vacuum chamber 11 has the passage 14 therein interposed between a pair of magnet arrays and a pair of magnet arrays composed of the first magnet array 12 and the second magnet array 13. Here, a direction in which magnet arrays face each other is not limited to an x direction, but may be a y direction.

In the first magnet array 12 and the second magnet array 13, magnetic poles that attract each other are alternately arranged in the z direction on magnetic pole surfaces that face each other, and thus a magnetic flux density distribution having a plurality of peaks in the passage 14 is generated.

Figure 2:
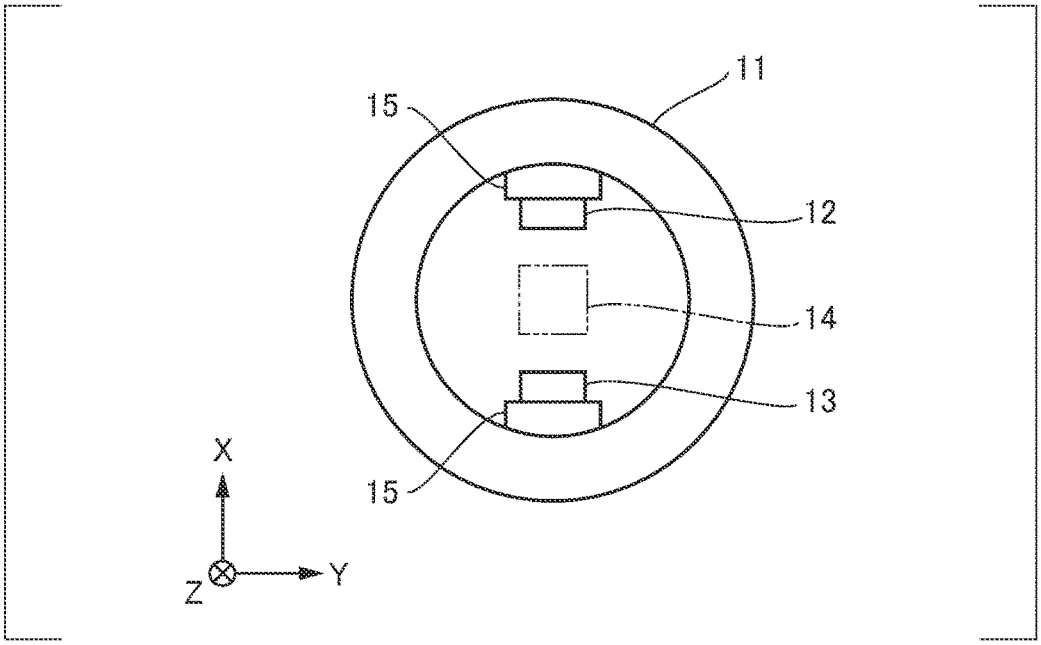
FIG. 2 is a diagram of the undulator when viewed in a z direction.

FIG. 2 is a diagram of the undulator 1 when viewed in the z direction. The first magnet array 12 and the second magnet array 13 are held by movable holding parts 15 that hold them in the vacuum chamber 11. The holding parts 15 are movable in the x direction and can adjust an interval between the first magnet array 12 and the second magnet array 13 in the x direction.

<Undulator Magnet>

Figure 3A:
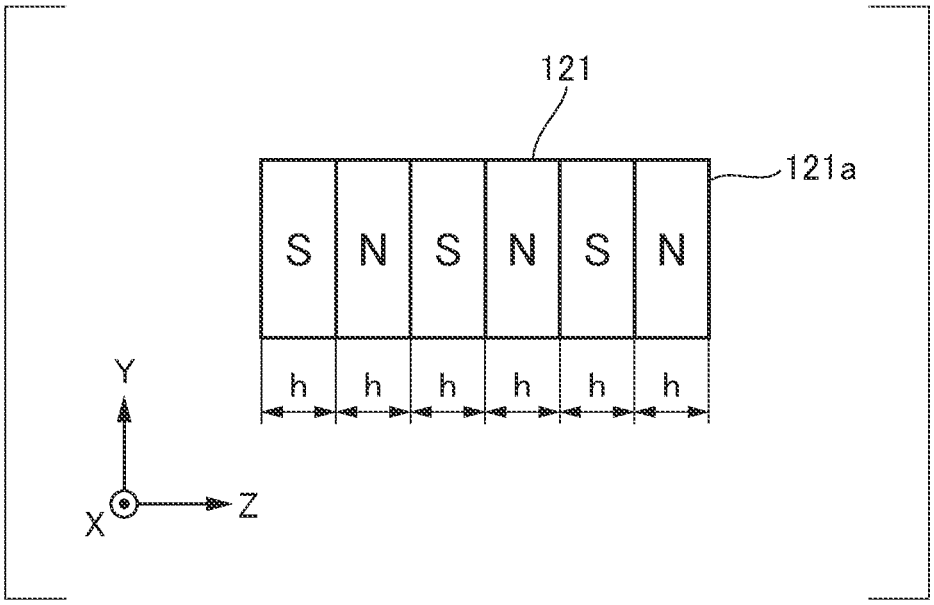
FIGS. 3A and 3B show diagrams of an example of a shape of an undulator permanent magnet included in a first magnet array.
Figure 3B:
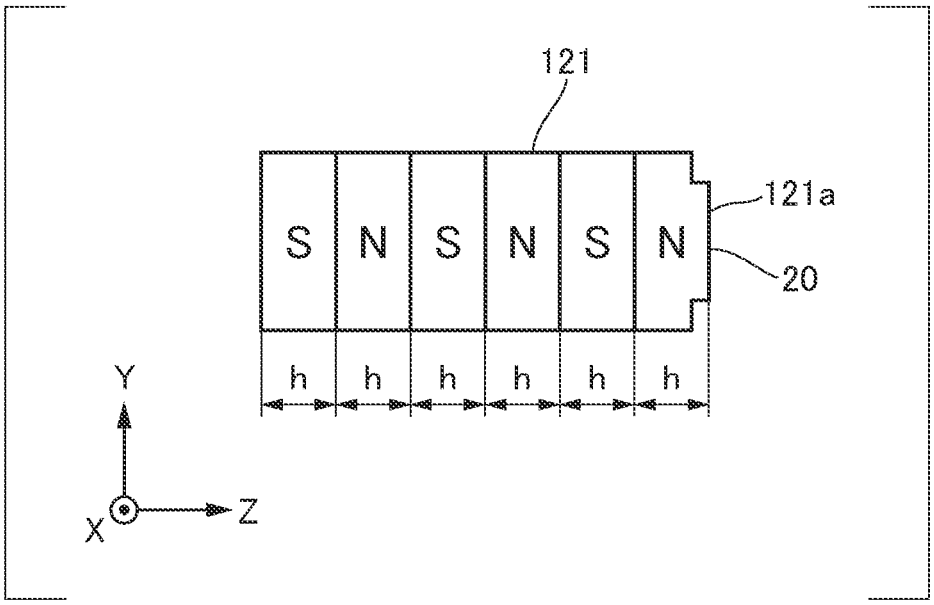

In the present embodiment, using a pair of magnets in which undulator permanent magnets having the following configuration are connected, the first magnet array 12 and the second magnet array 13 are lengthened in the z direction. FIGS. 3A and 3B show diagrams of an example of a shape of an undulator permanent magnet 121 included in the first magnet array 12. The undulator permanent magnet 121 has a first connecting surface 121*a* connected to another undulator permanent magnet.

As shown in FIG. 3A, the undulator permanent magnet 121 has a rectangular shape whose long side extends in the z direction when viewed from the magnetic pole surface. The first connecting surface 121*a* is formed on one end surface in the z direction. In the example shown in FIG. 3A, the outline of the first connecting surface 121*a* when viewed from the magnetic pole surface extends in the y direction. As shown in FIG. 3B, the central part of the first connecting surface 121*a* in the y direction may have a convex part (convex connecting part) 20 that is convex in the z direction. In this case, the width of the convex part 20 in the y direction is assumed to be sufficiently larger than a deflection width of an electron trajectory in the y direction.

Similarly, another undulator permanent magnet connected to the undulator permanent magnet 121 has a first connecting surface. When the first connecting surface 121*a* has the convex part 20, the first connecting surface of the other undulator permanent magnet is concave in the z direction, and has a concave part (concave connecting part) fit into the convex part 20. These undulator permanent magnets are connected to each other on first connecting surfaces and form a pair of magnets. In such a configuration, it is possible to prevent erroneous arrangement in the z direction when two undulator permanent magnets are connected. In addition, as shown in FIGS. 3A and 3B, a magnetic pole width h of the undulator permanent magnet 121 is uniform from the first connecting surface 121*a* to the other surface in the z direction.

Figure 4:
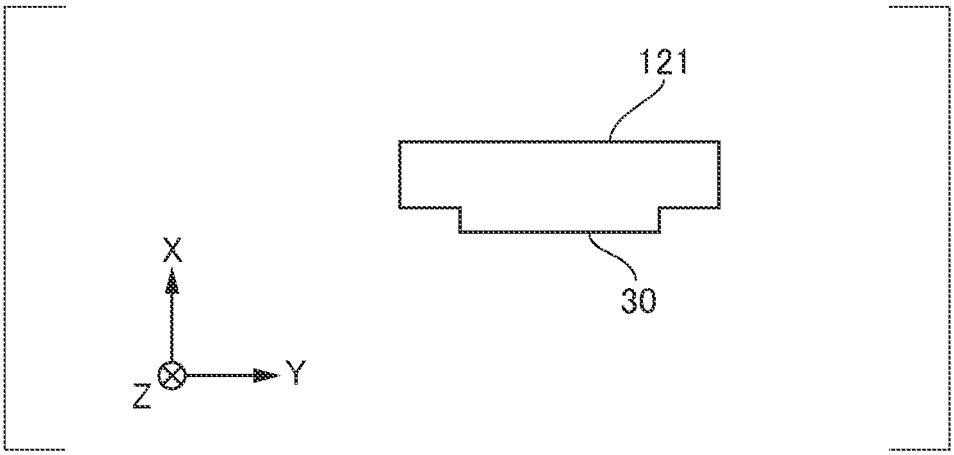
FIG. 4 is a diagram showing another example of a shape of an undulator permanent magnet included in a first magnet array.

FIG. 4 is a diagram showing another example of a shape of the undulator permanent magnet 121 included in the first magnet array 12. The undulator permanent magnet 121 may have a convex part 30 that is convex in the x direction orthogonal to the z direction on any magnetic pole surface. In such a configuration, it is possible to prevent erroneous arrangement in the x direction when the undulator permanent magnet is arranged in the vacuum chamber 11.

Figure 5:
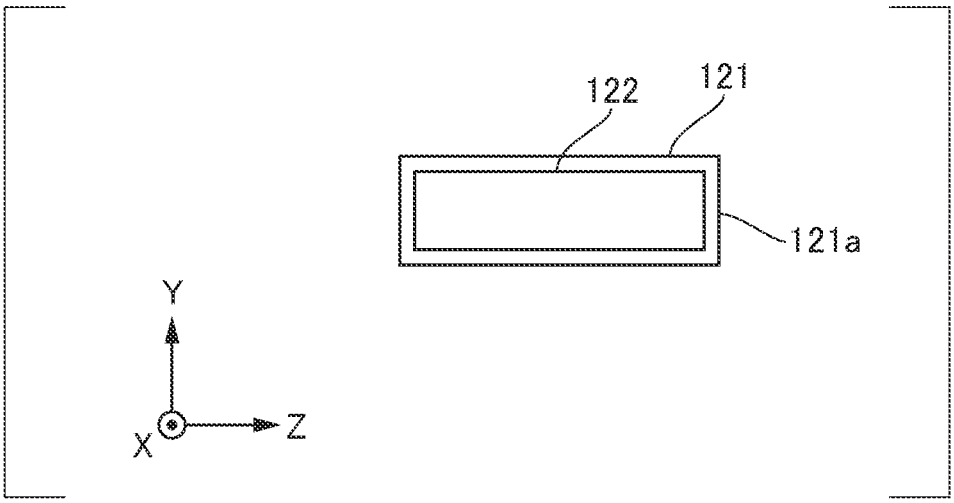
FIG. 5 is a diagram showing an undulator permanent magnet to which a yoke is attached.

FIG. 5 is a diagram showing the undulator permanent magnet 121 to which a yoke 122 is attached. The yoke 122 is attached to a magnetic pole surface on the side opposite to a magnetic pole surface that faces the passage 14 through which the electron beam e passes among magnetic pole surfaces of the undulator permanent magnet 121.

When the yoke 122 is attached, a magnetic force of the undulator permanent magnet 121 can be improved. In addition, it is possible to prevent the undulator permanent magnet 121 from breaking due to impact when the undulator permanent magnet 121 is transported or installed at the holding part 15.

The length of the yoke 122 in the z direction when it is attached to the undulator permanent magnet 121 is shorter than the length of the undulator permanent magnet 121 in the z direction. Therefore, no gap is generated between the undulator permanent magnet 121 and another undulator permanent magnet connected to the undulator permanent magnet 121 via the first connecting surface 121*a*. However, it is desirable that the length of the yoke 122 in the z direction be close to the length of the undulator permanent magnet 121 in the z direction within a range in which connection is not interfered with.

In addition, it is desirable that the length of the yoke 122 in the y direction when it is attached to the undulator permanent magnet 121 be shorter than the length of the undulator permanent magnet 121 in the y direction. For example, the undulator permanent magnet 121 is arranged on a pedestal having a guide (such as a step) for positioning in the y direction, and the pedestal is held by the holding part 15. When the length of the yoke 122 in the y direction is set as described above, positioning of the undulator permanent magnet 121 in the y direction is not inhibited. However, within a range in which positioning in the y direction is not interfered with, it is desirable that the length of the yoke 122 in the y direction be close to the length of the undulator permanent magnet 121 in the y direction.

<Magnetic Flux Density Distribution>

The undulator permanent magnet 121 is connected to another undulator permanent magnet and is then magnetized and has a magnetic flux density so that an amount of change in peaks of the magnetic flux density distribution in the z direction is reduced between the connecting part and the other parts. On one magnetic pole surface of the undulator permanent magnet 121 in the y direction, N poles and S poles are alternately arranged in the z direction, and thus a magnetic flux density distribution having a plurality of peaks is generated.

Figure 6:
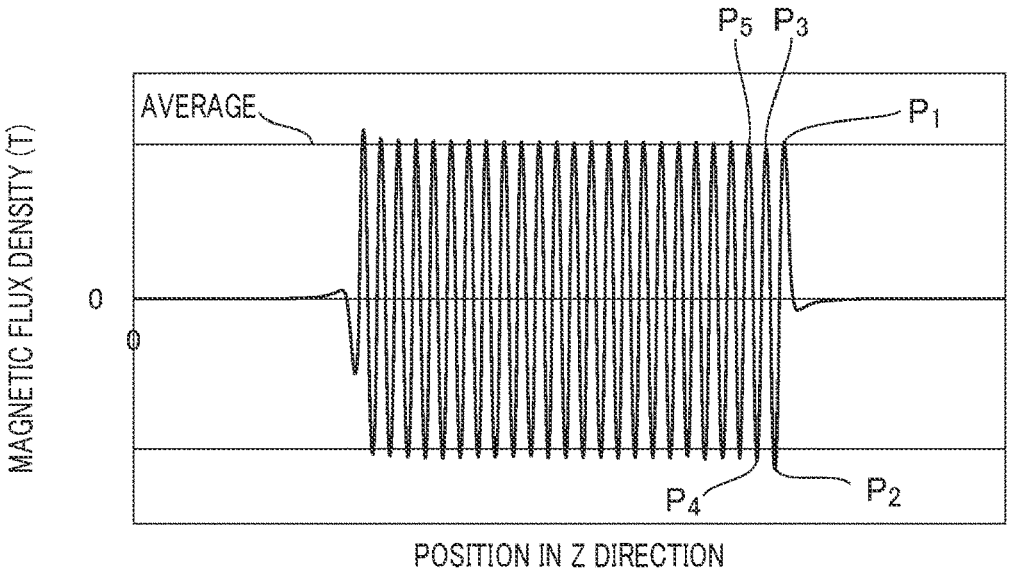
FIG. 6 is a diagram showing a magnetic flux density distribution of a magnetic pole surface in the z direction on the side opposite to electrons of the undulator permanent magnet.

FIG. 6 is a diagram showing a magnetic flux density distribution of a magnetic pole surface on the side opposite to electrons of the undulator permanent magnet 121 (a side that faces the passage 14) in the z direction. The horizontal axis represents a position in the z direction and the vertical axis represents a magnitude of a magnetic flux density. The side connected to another undulator permanent magnet is defined as a positive direction on the horizontal axis. In addition, regarding the vertical axis, a direction of the N pole is defined as a positive direction, and a direction of the S pole is defined as a negative direction.

As shown in FIG. 6, the magnetic flux density distribution has a plurality of peaks in the positive direction and the negative direction. The plurality of peaks are represented as the first to m-th peaks $P_m$ (m is an integer of 1 or more) in order from the side of the first connecting surface. A magnitude of the first peak $P_1$ is larger than a magnitude of the third peak $P_3$.

Figure 7:
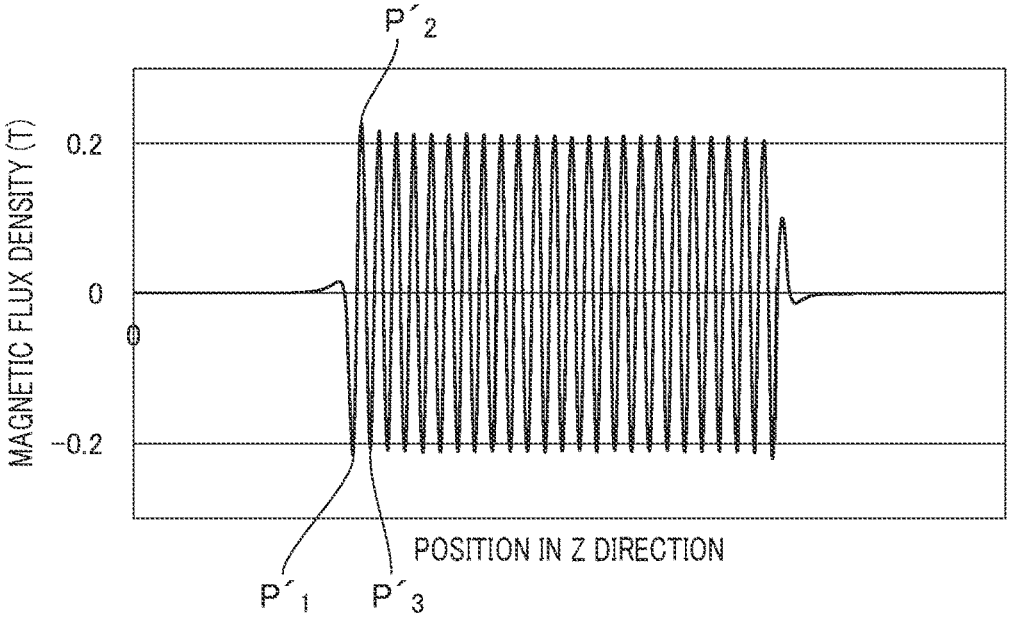
FIG. 7 is a diagram showing a magnetic flux density distribution of another undulator permanent magnet connected to the undulator permanent magnet.

FIG. 7 is a diagram showing a magnetic flux density distribution of another undulator permanent magnet connected to the undulator permanent magnet 121. The horizontal axis represents a position in the z direction and the vertical axis represents a magnitude of the magnetic flux density. The side connected to the undulator permanent magnet 121 (side of the first connecting surface) is defined as a negative direction on the horizontal axis. In addition, regarding the vertical axis, a direction of the N pole is defined as a positive direction, and a direction of the S pole is defined as a negative direction.

As shown in FIG. 7, the magnetic flux density distribution has a plurality of peaks in the positive direction and the negative direction. The plurality of peaks are represented as the first to $P'_m$-th peaks (m is an integer of 1 or more) in order from the side of the first connecting surface. A magnitude of the first peak $P'_1$ is larger than a magnitude of the third peak $P'_3$.

Figure 8:
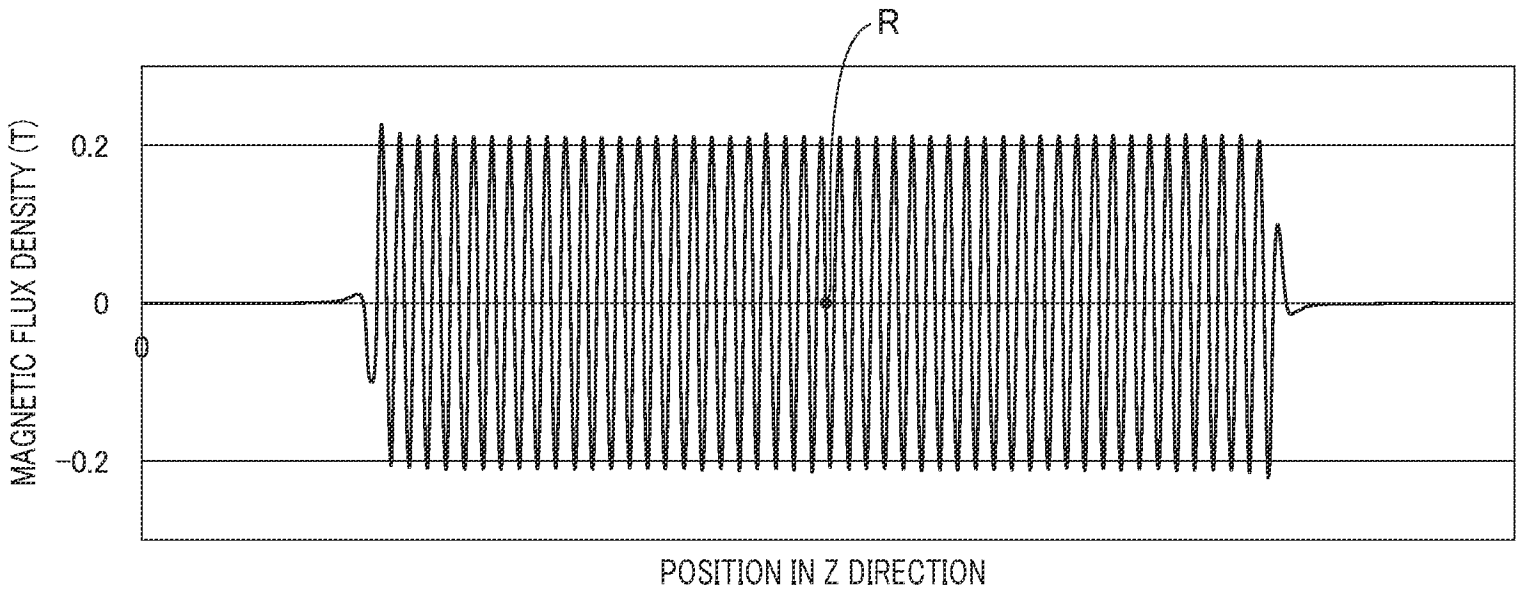
FIG. 8 is a diagram showing a magnetic flux density distribution of a pair of magnets in which two undulator permanent magnets shown in FIG. 6 and FIG. 7 are connected on respective first connecting surfaces.

The directions (magnetic pole) of the magnetic flux densities of the first peak $P_1$ and the first peak $P'_1$ which are the first peaks when viewed from the side of the first connecting surface in FIG. 6 and FIG. 7 are opposite to each other. FIG. 8 is a diagram showing a magnetic flux density distribution of a pair of magnets in which two undulator permanent magnets shown in FIG. 6 and FIG. 7 are connected on respective first connecting surfaces. Electrons are incident from the left in FIG. 8 and electrons are released from the right.

The horizontal axis represents a position in the z direction and the vertical axis represents a magnitude of a magnetic flux density. The side of a first connecting surface of the undulator permanent magnet 121 is defined as a positive direction on the horizontal axis. In addition, regarding the vertical axis, a direction of the N pole is defined as a positive direction and a direction of the S pole is defined as a negative direction. A position at which two undulator permanent magnets are connected is z=R.

As shown in FIG. 8, values of peaks around a position R do not largely change. A trajectory of electrons that pass through the passage 14 interposed between magnet arrays composed of a pair of magnets of the magnetic flux density distribution is more stable than a trajectory of electrons that pass through the passage 14 interposed between conventional magnet arrays composed of a pair of magnets in which magnets of a magnetic flux density distribution in which values of peaks change around the position R are connected in the z direction. Here, mutually opposed magnetic poles of magnet arrays with the passage 14 therebetween are magnetic poles that are different from each other.

Features of the magnetic flux density distribution in FIG. 6 will be described in detail. First, a magnitude of the second peak $P_2$ is larger than a magnitude of the fourth peak $P_4$. In addition, a magnitude of the fifth peak $P_5$ is larger than a magnitude of the third peak $P_3$ and is smaller than a magnitude of the first peak $P_1$. A magnitude of the first peak $P_1$ is larger than an average of magnitudes of a plurality of odd-numbered peaks from the side of the first connecting surface. A magnitude of the third peak $P_3$ is smaller than the average. The plurality of peaks are arranged at equal intervals in the z direction from the first connecting surface to the other end surface. In addition, magnetization widths of magnetic poles are formed at the same pitch as inter-peak distances from the first connecting surface 121*a* to the other end surface in the z direction.

In addition, when electrons are incident from the other end surface (end surface on which there is no first connecting surface) of the undulator permanent magnet 121, it is desirable that a magnitude of the first peak when viewed from the side of the other end surface be half of an average of magnitudes of a plurality of even-numbered peaks from the side of the first connecting surface. This similarly applies to a side from which electrons are released. FIG. 8 is an example of a magnetic flux density distribution when an electron incidence side is on the magnet in FIG. 6 and a release side is on the magnet in FIG. 7. In this magnet array, a magnetic field integral of all magnet arrays is zero (N pole integral=S pole integral), and the stability of the electron trajectory is improved.

As described above, even if the undulator permanent magnets magnetized in the magnetic flux density distribution of the present embodiment are connected after magnetization, a magnetic flux density distribution of a connecting part and a part near the connecting part is a magnetic flux density distribution having favorable stability that does not influence the stability of the electron trajectory, and the transportation workability is accordingly favorable.

Second Embodiment

While a connecting surface connected to another undulator magnet is provided only on one end surface in the first embodiment, a connecting surface is provided on both end surfaces in the present embodiment. That is, three or more magnets that are connected and can be lengthened at both ends of magnet arrays with the same accuracy as in the first embodiment can be used, which can be advantageous in workability and the stability of a magnetic flux density distribution. In addition, it is possible to obtain desired radiation light with high energy.

Figure 9:
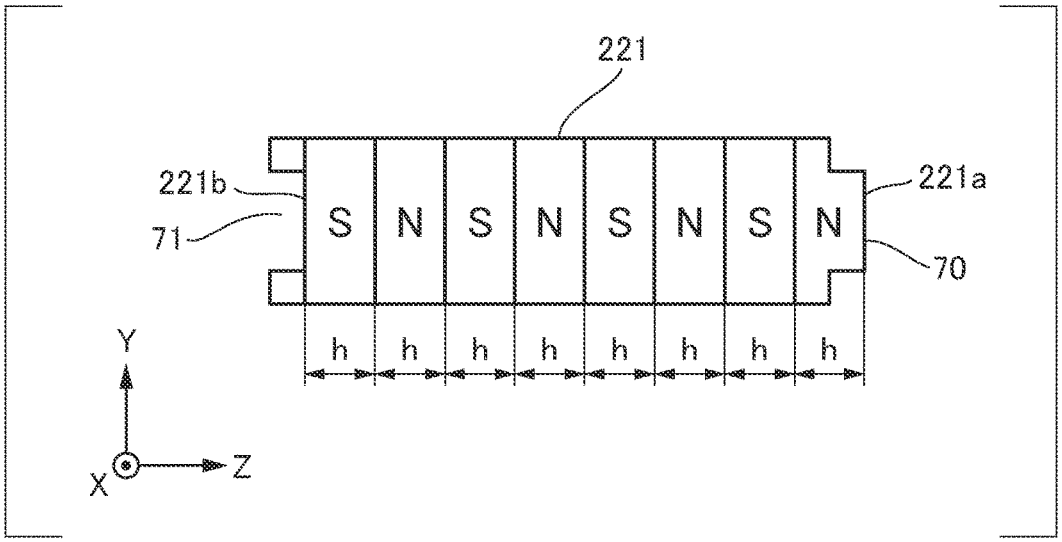
FIG. 9 is a diagram showing an example of a shape of an undulator permanent magnet of a second embodiment.

FIG. 9 is a diagram showing an example of a shape of an undulator permanent magnet 221 of the present embodiment. The undulator permanent magnet 221 includes a first connecting surface 221*a* and a second connecting surface 221*b* that are connected to another undulator permanent magnet.

The first connecting surface 221*a* has a convex part 70 that is convex in the z direction, and the second connecting surface 221*b* has a concave part 71 that is concave in the z direction. The first connecting surface 221*a* may have a concave part and the second connecting surface 221*b* may have a convex part. In addition, as shown in FIG. 3A, a convex part and a concave part may not be provided. Magnetic pole widths h of magnetic poles are formed at equal intervals from the first connecting surface 221*a* to the second connecting surface 221*b*.

The convex part 70 is fit into a concave part of another undulator permanent magnet. The other undulator permanent magnet having a concave part may be an undulator permanent magnet of the present embodiment or the undulator permanent magnet of the first embodiment. In this case, directions of the magnetic flux density of the first peak of undulator permanent magnets when viewed from the side of the connecting surface are opposite to each other.

Figure 10:
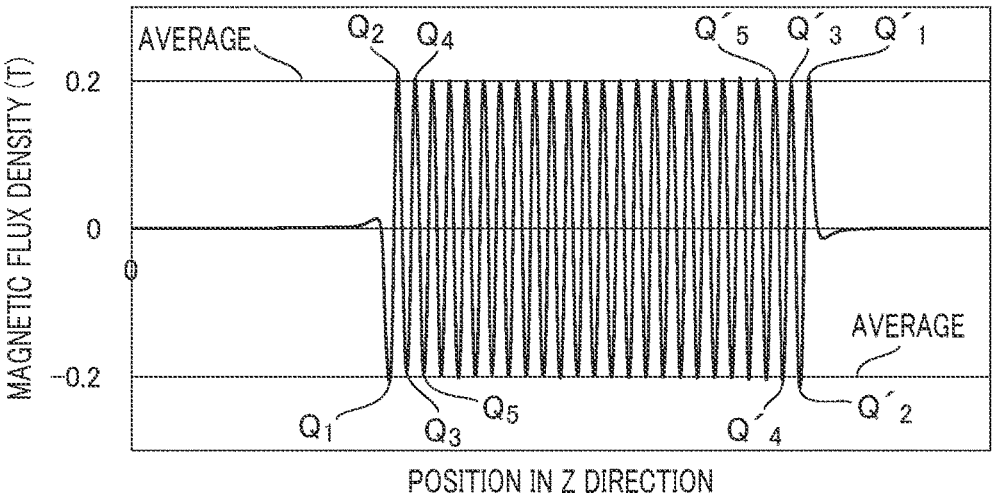
FIG. 10 is a diagram showing a magnetic flux density distribution of a magnetic pole surface in the z direction on the side that faces electrons of the undulator magnet of the second embodiment.

FIG. 10 is a diagram showing a magnetic flux density distribution of the magnetic pole surface in the z direction on the side that faces electrons of the undulator permanent magnet 221 of the present embodiment. The horizontal axis represents a position in the z direction and the vertical axis represents a magnitude of a magnetic flux density. The side of the first connecting surface 221*a* is defined as a positive direction on the horizontal axis and the side of the second connecting surface 221*b* is defined as a negative direction on the horizontal axis. In addition, regarding the vertical axis, a direction of the N pole is defined as a positive direction, and a direction of the S pole is defined as a negative direction.

As shown in FIG. 10, the magnetic flux density distribution has a plurality of peaks in the positive direction and the negative direction. The plurality of peaks are represented as the first to n-th peaks $Q_n$ (n is an integer of 1 or more) in order from the side of the second connecting surface 221*b*. A magnitude of the first peak $Q_1$ is larger than a magnitude of the third peak $Q_3$. In addition, in order from the side of the first connecting surface 221*a*, the first to n-th peaks $Q'_n$ (n is an integer of 1 or more) are represented. A magnitude of the first peak $Q'_1$ is larger than a magnitude of the third peak $Q'_3$. When the length of the magnet array used for the undulator is an integer multiple of a period length (a length of one period of change of the magnetic flux density in the z direction), a direction of the magnetic flux density of the first peak $Q'_1$ and a direction of the magnetic flux density of the first peak $Q_1$ are opposite to each other.

Features of the magnetic flux density distribution in FIG. 10 will be described in detail. A magnitude of the second peak $Q_2$ is larger than a magnitude of the fourth peak $Q_4$. A magnitude of the fifth peak $Q_5$ is larger than a magnitude of the third peak $Q_3$ and is smaller than a magnitude of the first peak $Q_1$. A magnitude of the first peak $Q_1$ is larger than an average of magnitudes of a plurality of odd-numbered peaks from the side of the second connecting surface 221*b*. A magnitude of the third peak $Q_3$ is smaller than an average of magnitudes of a plurality of odd-numbered peaks from the side of the second connecting surface 221*b*.

In addition, a magnitude of the second peak $Q'_2$ is larger than a magnitude of the fourth peak $Q'_4$. A magnitude of the fifth peak $Q'_5$ is larger than a magnitude of the third peak $Q'_3$ and is smaller than a magnitude of the first peak $Q'_1$. A magnitude of the first peak $Q'_1$ is larger than an average of magnitudes of a plurality of odd-numbered peaks from the side of the first connecting surface 221*a*. A magnitude of the third peak $Q'_3$ is smaller than an average of magnitudes of a plurality of odd-numbered peaks from the side of the first connecting surface 221*a*.

In addition, an integral value of the magnetic flux density at one magnetic pole (integral value of a magnetic flux density of 0 or more on the vertical axis) and an integral value of the magnetic flux density at the other magnetic pole (integral value of the magnetic flux density of less than 0 on the vertical axis) are equal.

Figure 11:
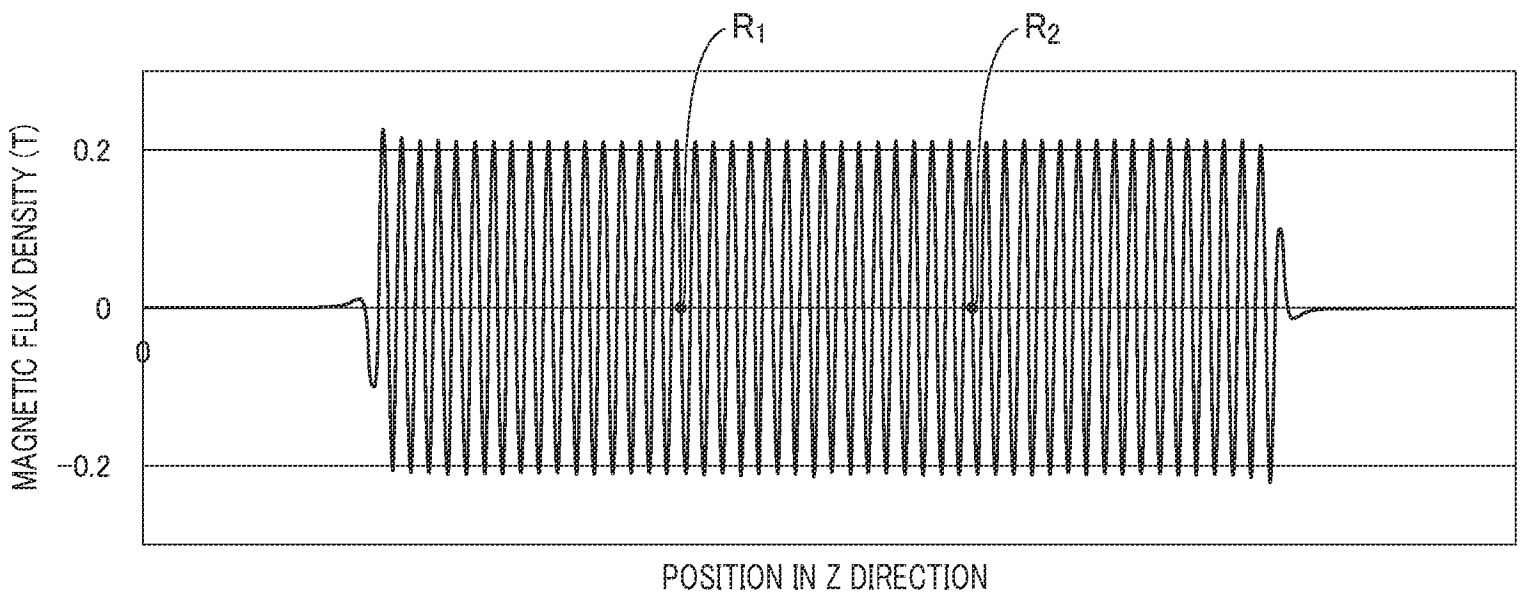
FIG. 11 is a diagram showing a magnetic flux density distribution of a magnet array in which three undulator permanent magnets are connected using the undulator permanent magnet of the second embodiment and the undulator permanent magnet of the first embodiment.

FIG. 11 is a diagram showing a magnetic flux density distribution of a magnet array in which three undulator permanent magnets are connected using an undulator permanent magnet of the present embodiment and the undulator permanent magnet of the first embodiment. The first connecting surface of the undulator permanent magnet shown in FIG. 6 is connected to the second connecting surface of the undulator permanent magnet shown in FIG. 10, and the first connecting surface of the undulator permanent magnet shown in FIG. 10 is connected to the first connecting surface of the undulator permanent magnet shown in FIG. 7.

Directions (magnetic poles) of the magnetic flux densities of the first peak $P_1$ which is the first peak when viewed from the side of the first connecting surface of the undulator permanent magnet shown in FIG. 6 and the first peak $Q_1$ which is the first peak when viewed from the side of the second connecting surface of the undulator permanent magnet shown in FIG. 10 are opposite to each other.

In addition, directions (magnetic poles) of the magnetic flux densities of the first peak $P'_1$ which is the first peak when viewed from the side of the first connecting surface of the undulator permanent magnet shown in FIG. 7 and the first peak $Q'_1$ which is the first peak when viewed from the side of the first connecting surface of the undulator permanent magnet shown in FIG. 10 are opposite to each other.

The horizontal axis represents a position in the z direction and the vertical axis represents a magnitude of a magnetic flux density. The side of the first connecting surface of the undulator permanent magnet shown in FIG. 6 is defined as a positive direction on the horizontal axis. In addition, regarding the vertical axis, a direction of the N pole is defined as a positive direction and a direction of the S pole is defined as a negative direction. A position at which the undulator permanent magnet shown in FIG. 6 and the undulator permanent magnet shown in FIG. 10 are connected is $z=R_1$. A position at which the undulator permanent magnet shown in FIG. 7 and the undulator permanent magnet shown in FIG. 10 are connected is $z=R_2$.

As shown in FIG. 11, values of peaks around a position $R_1$ and a position $R_2$ do not largely change. Similarly to the first embodiment, a trajectory of electrons that pass through the passage 14 interposed between magnet arrays shown in FIG. 11 is more stable than a trajectory of electrons that pass through the passage 14 interposed between conventional magnet arrays. Here, mutually opposed magnetic poles of magnet arrays with the passage 14 therebetween are magnetic poles that are different from each other.

While the undulator permanent magnet shown in FIG. 7 is connected to the undulator permanent magnet shown in FIG. 10 in the second embodiment, the undulator permanent magnet shown in FIG. 10 may be connected in place of the undulator permanent magnet shown in FIG. 7. In this case, when a plurality of undulator permanent magnets shown in FIG. 10 are connected, it is possible to form a magnet array in which four or more magnets are connected.

Third Embodiment

<Radiation Light Generating Device>

Figure 12:
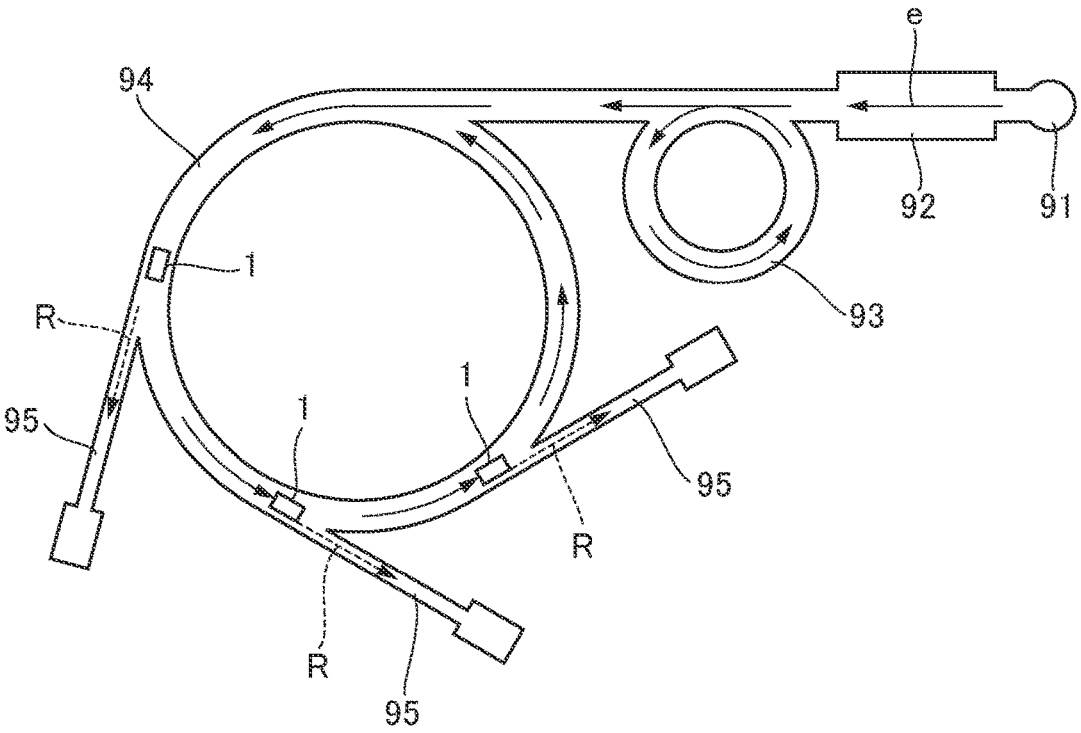
FIG. 12 is an overview diagram of a radiation light generating device including an undulator using the undulator permanent magnet of the first embodiment or the second embodiment.

The undulator using the undulator permanent magnet of the above embodiment is used for a radiation light generating device. FIG. 12 is an overview diagram of a radiation light generating device including the undulator using the undulator permanent magnet of the above embodiment.

A radiation light generating device 9 includes an electron gun 91, a linear accelerator 92, a synchrotron 93, a storage ring 94, and a beam line 95. The undulator 1 is arranged in the storage ring 94 near a base of the beam line 95.

An electron beam e generated from the electron gun 91 is accelerated to about 1 GeV by the linear accelerator 92. The accelerated electron beam e is introduced into the synchrotron 93, reaches a speed near the speed of light with an energy of about 8 GeV, and enters the storage ring 94. The electron beam e travels in the storage ring 94 at the speed of light while maintaining its energy, is meandered by the undulator 1, and emits radiation light R. The radiation light R enters the beam line 95, and is used in the beam line 95 for various research and practical applications.

Here, while magnets are individually magnetized and then connected in the above embodiment, magnets may be connected and then magnetized. After magnetization of a magnetic flux density distribution of the above embodiment is performed in the connecting part, even if the connecting is released and connecting is then performed again, an amount of change in peaks of the magnetic flux density distribution in the z direction is reduced between the connecting part and the other parts.

In all magnet arrays constituting the undulator, magnetic field integrals of the N pole and the S pole are desirably equal to each other. In addition, for example, reducing the number of types of magnets constituting the magnet array as much as possible is important in consideration of costs.

In order to make magnetic field integrals for all magnet arrays equal without increasing the number of types of magnets used, it is desirable to make a pole at one end of the magnet array and a pole at the other end different from each other. When both ends of the magnet array are set to have the same pole, it is necessary to use a plurality of types of magnets for the magnet arrays in order to equalize the magnetic field integrals for all magnet arrays. For example, the plurality of types of magnets are obtained by adjusting the length of the magnet in the z direction and adjusting the magnetic flux density at the end.

The undulator permanent magnets according to the first embodiment and the second embodiment can be connected and lengthened after being transported rather than being connected and lengthened and then transported. Thus, this is advantageous in the workability. A method of installing the undulator permanent magnets according to the first embodiment and the second embodiment in an undulator is, for example, as follows.

First, permanent magnets are magnetized so that they have a magnetic flux density distribution shown in the first embodiment and the second embodiment. After magnetization, the permanent magnets are accommodated in a transport container for transportation such as an acrylic case, and are transported to the undulator 1 arranged near a base of the beam line 95 in the storage ring 94 of the radiation light generating device 9. Then, when the permanent magnets are held by the holding part 15 of the undulator 1, they are connected and lengthened.

Other Embodiments

While the embodiments of the present invention have been described above, the present invention is not limited to these embodiments, and various modifications can be made within the scope of the gist of the invention.

REFERENCE SIGNS LIST

1 Undulator
11 Vacuum chamber
12 First magnet array
13 Second magnet array
121 Undulator permanent magnet

What is claimed is:

1. An undulator permanent magnet used for an undulator that generates radiation light by meandering electrons that travel in a first direction, wherein, in the undulator permanent magnet, one end surface in the first direction forms a first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$.

2. The undulator permanent magnet according to claim 1, wherein a magnitude of the second peak $P_2$ is larger than a magnitude of the fourth peak $P_4$.

3. The undulator permanent magnet according to claim 1, wherein a magnitude of the fifth peak $P_5$ is larger than the magnitude of the third peak $P_3$ and is smaller than the magnitude of the first peak $P_1$.

4. The undulator permanent magnet according to claim 1, wherein the magnitude of the first peak $P_1$ is larger than an average of magnitudes of the plurality of odd-numbered peaks from the side of the first connecting surface.

5. The undulator permanent magnet according to claim 1, wherein the magnitude of the third peak $P_3$ is smaller than an average of magnitudes of the plurality of odd-numbered peaks from the side of the first connecting surface.

6. The undulator permanent magnet according to claim 1, wherein the magnitude of the first peak when viewed from the side of the other end surface in the first direction among the plurality of peaks is half of an average of magnitudes of the plurality of even-numbered peaks from the side of the first connecting surface.

7. The undulator permanent magnet according to claim 1, wherein widths of a plurality of magnetic poles formed on the magnetic pole surface are equal in the first direction from the first connecting surface to the other end surface in the first direction.

8. The undulator permanent magnet according to claim 1, wherein a convex connecting part that is convex in the second direction is provided on any one of one magnetic pole surface and the other magnetic pole surface in the second direction.

9. The undulator permanent magnet according to claim 1, wherein the first connecting surface has a convex connecting part that is convex in the first direction or a concave connecting part that is concave in the first direction.

10. The undulator permanent magnet according to claim 1, wherein a yoke is attached to a magnetic pole surface opposite to a magnetic pole surface that faces a path through which the electrons pass within the magnetic pole surface in the second direction.

11. The undulator permanent magnet according to claim 1, wherein the length of the yoke in the first direction is shorter than the length of the opposite magnetic pole surface in the first direction.

12. The undulator permanent magnet according to claim 1, wherein the length of the yoke in a third direction that is orthogonal to the first direction and the second direction is shorter than the length of the opposite magnetic pole surface in the third direction.

13. A pair of magnets formed by connecting the undulator permanent magnets according to claim 1 on the first connecting surfaces, wherein a direction of a magnetic flux density of a first peak when viewed from the side of the first connecting surface of a magnetic flux density distribution in the first direction of one undulator permanent magnet of the pair of magnets and a direction of a magnetic flux density of a first peak when viewed from the side of the first connecting surface of a magnetic flux density distribution in the first direction of the other undulator permanent magnet of the pair of magnets are opposite to each other.

14. The undulator permanent magnet according to claim 1, wherein the other end surface in the first direction is a second connecting surface connected to another undulator permanent magnet, wherein, when the plurality of peaks are represented as the first to n-th peaks $Q_n$ (n is an integer of 1 or more) in order from the side of the second connecting surface, a magnitude of the first peak $Q_1$ is larger than a magnitude of the third peak $Q_3$, and wherein a direction of a magnetic flux density of the first peak $P_1$ and a direction of a magnetic flux density of the first peak $Q_1$ are opposite to each other.

15. The undulator permanent magnet according to claim 14, wherein a magnitude of the second peak $Q_2$ is larger than a magnitude of the fourth peak $Q_4$.

16. The undulator permanent magnet according to claim 14, wherein a magnitude of the fifth peak $Q_5$ is larger than the magnitude of the third peak $Q_3$ and is smaller than the magnitude of the first peak $Q_1$.

17. The undulator permanent magnet according to claim 14, wherein the magnitude of the first peak $Q_1$ is larger than an average of magnitudes of the plurality of odd-numbered peaks from the side of the second connecting surface.

18. The undulator permanent magnet according to claim 14, wherein the magnitude of the third peak $Q_3$ is smaller than an average of magnitudes of the plurality of odd-numbered peaks from the side of the second connecting surface.

19. The undulator permanent magnet according to claim 14, wherein one of the first connecting surface and the second connecting surface is one of a convex connecting part that is convex in the first direction and a concave connecting part that is concave in the first direction, and the other of the first connecting surface and the second connecting surface is the other of the convex connecting part and the concave connecting part.

20. The undulator permanent magnet according to claim 14, wherein widths of a plurality of magnetic poles formed on the magnetic pole surface are equal in the first direction from the first connecting surface to the second connecting surface.

21. The undulator permanent magnet according to claim 14, wherein, regarding the magnetic flux density distribution, an integral value of the magnetic flux density in the one magnetic pole is equal to an integral value of the magnetic flux density in the other magnetic pole.

22. An undulator that generates radiation light by meandering electrons, comprising:

a vacuum chamber having a passage therein through which the electrons pass in a predetermined direction; and a pair of magnet arrays that are arranged to face each other with the passage therebetween in the vacuum chamber, wherein each of the pair of magnet arrays includes, on magnetic pole surfaces that face each other, magnetic poles that attract each other and are alternately arranged in the predetermined direction such that a magnetic flux density distribution having a plurality of peaks in the passage is generated, and a pair of magnets formed by connecting the undulator permanent magnets according to claim 1 on the first connecting surfaces, in an undulator permanent magnet used for an undulator that generates radiation light by meandering electrons that travel in a first direction, wherein, in the undulator permanent magnet, one end surface in the first direction forms a first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$, and wherein a direction of a magnetic flux density of a first peak when viewed from the side of the first connecting surface of a magnetic flux density distribution in the first direction of one undulator permanent magnet of the pair of magnets and a direction of a magnetic flux density of a first peak when viewed from the side of the first connecting surface of a magnetic flux density distribution in the first direction of the other undulator permanent magnet of the pair of magnets are opposite to each other.

23. An undulator that generates radiation light by meandering electrons, comprising:

a vacuum chamber having a passage therein through which the electrons pass in a predetermined direction; and a pair of magnet arrays that are arranged to face each other with the passage therebetween in the vacuum chamber, wherein each of the pair of magnet arrays includes, on magnetic pole surfaces that face each other, magnetic poles that attract each other and are alternately arranged in the predetermined direction such that a magnetic flux density distribution having a plurality of peaks in the passage is generated, and a pair of magnets formed by connecting the undulator permanent magnets according to claim 15 on the first connecting surface and the second connecting surface.

24. An undulator that generates radiation light by meandering electrons, comprising:

a vacuum chamber having a passage therein through which the electrons pass in a predetermined direction; and a pair of magnet arrays that are arranged to face each other with the passage therebetween in the vacuum chamber, wherein each of the pair of magnet arrays includes, on magnetic pole surfaces that face each other, magnetic poles that attract each other and are alternately arranged in the predetermined direction such that a magnetic flux density distribution having a plurality of peaks in the passage is generated, and a pair of magnets formed by connecting a first connecting surface of an undulator permanent magnet used for an undulator that generates radiation light by meandering electrons that travel in a first direction in which one end surface in the first direction forms the first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$, and the first connecting surface has a convex connecting part that is convex in the first direction, and a first connecting surface or a second connecting surface of the undulator permanent magnet used for an undulator that generates radiation light by meandering electrons that travel in the first direction in which one end surface in the first direction forms the first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$, the other end surface in the first direction is the second connecting surface connected to another undulator permanent magnet, when the plurality of peaks are represented as the first to n-th peaks $Q_n$ (n is an integer of 1 or more) in order from the side of the second connecting surface, a magnitude of the first peak $Q_1$ is larger than a magnitude of the third peak $Q_3$, a direction of a magnetic flux density of the first peak $P_1$ and a direction of a magnetic flux density of the first peak $Q_1$ are opposite to each other, and one of the first connecting surface and the second connecting surface is a concave connecting part that is concave in the first direction, wherein a direction of a magnetic flux density of a first peak when viewed from the side of a connecting surface of the pair of magnets of a magnetic flux density distribution in the first direction of one undulator permanent magnet of the pair of magnets and a direction of a magnetic flux density of a first peak when viewed from the side of the connecting surface of a magnetic flux density distribution in the first direction of the other undulator permanent magnet of the pair of magnets are opposite to each other.

25. An undulator that generates radiation light by meandering electrons, comprising:

a vacuum chamber having a passage therein through which the electrons pass in a predetermined direction; and a pair of magnet arrays that are arranged to face each other with the passage therebetween in the vacuum chamber, wherein each of the pair of magnet arrays includes, on magnetic pole surfaces that face each other, magnetic poles that attract each other and are alternately arranged in the predetermined direction such that a magnetic flux density distribution having a plurality of peaks in the passage is generated, and a pair of magnets formed by connecting a first connecting surface of an undulator permanent magnet including a concave connecting part of the undulator permanent magnet used for an undulator that generates radiation light by meandering electrons that travel in the first direction in which one end surface in the first direction forms the first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$, and the first connecting surface has the concave connecting part that is concave in the first direction, and a first connecting surface or a second connecting surface of the undulator permanent magnet used for an undulator that generates radiation light by meandering electrons that travel in the first direction in which one end surface in the first direction forms the first connecting surface connected to another undulator permanent magnet, N poles and S poles are alternately arranged in the first direction on one magnetic pole surface in a second direction orthogonal to the first direction, and thus a magnetic flux density distribution having a plurality of peaks is generated, and when the plurality of peaks are represented as the first to m-th peaks $P_m$ (m is an integer of 1 or more) in order from the side of the first connecting surface, a magnitude of the first peak $P_1$ is larger than a magnitude of the third peak $P_3$, the other end surface in the first direction is the second connecting surface connected to another undulator permanent magnet, when the plurality of peaks are represented as the first to n-th peaks $Q_n$ (n is an integer of 1 or more) in order from the side of the second connecting surface, a magnitude of the first peak $Q_1$ is larger than a magnitude of the third peak $Q_3$, a direction of a magnetic flux density of the first peak $P_1$ and a direction of a magnetic flux density of the first peak $Q_1$ are opposite to each other, and one of the first connecting surface and the second connecting surface is a convex connecting part that is convex in the first direction, wherein a direction of a magnetic flux density of a first peak when viewed from the side of a connecting surface of the pair of magnets of a magnetic flux density distribution in the first direction of one undulator permanent magnet of the pair of magnets and a direction of a magnetic flux density of a first peak when viewed from the side of the connecting surface of a magnetic flux density distribution in the first direction of the other undulator permanent magnet of the pair of magnets are opposite to each other.

26. A radiation light generating device comprising an undulator, wherein the undulator is an undulator that generates radiation light by meandering electrons and includes a vacuum chamber having a passage therein through which the electrons pass in a predetermined direction; and a pair of magnet arrays that are arranged to face each other with the passage therebetween in the vacuum chamber, wherein each of the pair of magnet arrays includes on magnetic pole surfaces that face each other, magnetic poles that attract each other and are alternately arranged in the predetermined direction such that a magnetic flux density distribution having a plurality of peaks in the passage is generated, and a pair of magnets formed by connecting the undulator permanent magnets according to claim 1 on the first connecting surfaces, wherein a direction of a magnetic flux density of a first peak when viewed from the side of the first connecting surface of a magnetic flux density distribution in the first direction of one undulator permanent magnet of the pair of magnets and a direction of a magnetic flux density of a first peak when viewed from the side of the first connecting surface of a magnetic flux density distribution in the first direction of the other undulator permanent magnet of the pair of magnets are opposite to each other.

* * * * *